US006929211B1

(12) United States Patent
Mager et al.

(10) Patent No.: US 6,929,211 B1
(45) Date of Patent: Aug. 16, 2005

(54) METHOD OF WINDING YARNS TO FORM FRUSTOCONICAL YARN PACKAGES

(75) Inventors: Guenther Mager, Stolberg (DE); Patrick Moireau, Curienne (FR)

(73) Assignee: Saint-Gobain Vetrotex France S.A., Chambery (FR)

( * ) Notice: Subject to any disclaimer, the term of this patent is extended or adjusted under 35 U.S.C. 154(b) by 179 days.

(21) Appl. No.: 10/031,574

(22) PCT Filed: Jun. 28, 2000

(86) PCT No.: PCT/FR00/01800

§ 371 (c)(1),
(2), (4) Date: May 1, 2002

(87) PCT Pub. No.: WO01/07350

PCT Pub. Date: Feb. 1, 2001

(30) Foreign Application Priority Data

Jul. 22, 1999 (FR) ..... 99 09506

(51) Int. Cl.[7] ..... B65H 54/28

(52) U.S. Cl. ..... 242/480.4; 242/478.5; 242/920 B

(58) Field of Search ..... 242/479.4, 479.8, 242/480.4, 476.8, 478.5, 920

(56) References Cited

U.S. PATENT DOCUMENTS 2,858,993 A * 11/1958 Siegenthaler ..... 242/476
2,965,322 A * 12/1960 Wiering ..... 242/480.4
3,114,511 A * 12/1963 Geen ..... 242/476.8

(Continued)

FOREIGN PATENT DOCUMENTS

FR 2 285 326 4/1976
FR 2 380 209 9/1978
FR 2 703 671 10/1994

(Continued)

OTHER PUBLICATIONS

Mettler H: "Bobinage Reducteur de Casses Reducing Weft Breakages Through Winding" Industrie Textile, FR, Industrie Textile, Paris, No. 1247, Oct. 1, 1993 pp. 39-41, XP000404292 ISSN: 0019-9176 p. 41, colonne de droite; figure 6.

*Primary Examiner*—Kathy Matecki
(74) *Attorney, Agent, or Firm*—Oblon, Spivak, McClelland, Maier & Neustadt, P.C.

(57) ABSTRACT

Method of manufacturing a frustoconical bobbin which is obtained by depositing superposed layers of a yarn onto a cylindrical support of longitudinal axis and comprises a base cone having a generatrix, an unwind cone having a generatrix and a main body having a generatrix which is inclined with respect to the axis and joins the two generatrices of the two cones. The method is characterized in that it comprises two rules governing the movement of the yarn guide, a first rule which is used to form part of the base cone, the last layer of yarn deposited according to this first rule going as far as the end of the unwind cone, and a second rule which is used to terminate the said base cone that has been started and, concomitantly, to form the main body and the unwind cone, the first layer of yarn deposited according to the second rule being parallel to the last layer deposited according to the first rule.

19 Claims, 6 Drawing Sheets

U.S. PATENT DOCUMENTS

| | | | | | |
|---|---|---|---|---|---|
| 3,188,013 | A | * | 6/1965 | Geen | 242/480.4 |
| 3,259,337 | A | * | 7/1966 | De Ruig | 242/178 |
| 3,342,437 | A | * | 9/1967 | Massey | 242/178 |
| 3,367,588 | A | * | 2/1968 | Wolf | 242/478.5 |
| 3,373,945 | A | | 3/1968 | Johnson | |
| 5,556,045 | A | * | 9/1996 | Johnson et al. | 242/480.4 |

FOREIGN PATENT DOCUMENTS

| | | | | | |
|---|---|---|---|---|---|
| FR | 1 376 392 | | | 2/1995 | |
| JP | 03033229 | A | * | 2/1991 | D01H 1/36 |
| JP | 10 218489 | | | 11/1998 | |

* cited by examiner

METHOD OF WINDING YARNS TO FORM FRUSTOCONICAL YARN PACKAGES

BACKGROUND OF THE INVENTION

1. Field of the Invention

The invention relates to the manufacture of yarn packages for yarns such as glass yarns, and more particularly to the manufacture of frustoconical packages.

2. Description of Related Art

Yarn packages in the form of bobbins are a standard means of temporarily storing yarn, in order subsequently for it to be fed into yarn-handling machines, for example textile machines.

In the case of glass yarns, glass filaments obtained by molten glass flowing through orifices in a bushing are drawn. Next, these filaments are coated with a sizing composition by a coater so as to facilitate the fiberizing and the collecting of the filaments into a yarn and to increase their mechanical properties, especially upon ageing. These filaments are then brought together into a combining device in order to create the yarn to be wound. The yarn coming from the combining device is wound around a support which lies in a horizontal plane perpendicular to the vertical plane in which the yarn arrives and is driven in a rotational movement at a constant speed. Usually, the yarn to be wound runs over the surface of a yarn guide which is located between the combining device and the support and moves in a backward and forward motion parallel to the longitudinal axis of the rotating support.

The bobbin of yarn thus obtained is called a cake. However, a cake is rarely used directly for feeding the yarn into textile machines for example.

This is because textile machines operate at high speed and the yarn must then be easily extractable from the bobbin to avoid any rubbing which could cause a break, something which is difficult to achieve using cakes. It is then necessary to manufacture, from these intermediate bobbins called cakes, cyclindrical bobbins from the yarn of which is twisted.

However, to avoid these various steps, namely cake manufacture followed by unwinding, in order to rewind yarn that has previously undergone a twist, which steps are long and require numerous means, frustoconical bobbins have been formed without manufacturing an intermediate cake, the yarn of which comes directly from the bushing and is not twisted.

This is because frustoconical shapes prevent the yarn from twisting and facilitate high-speed unwinding, the yarn being driven along the axis of the bobbin towards its smallest diameter and consequently moving immediately away from the bobbin as soon as a coil becomes detached therefrom.

Application FR 2,703,671 teaches a method of winding yarn for the formation of a frustoconical bobbin using a drawn yarn that has come directly from a bushing and has not undergone a twisting operation. The yarn, which is taken through the yarn guide, is wound around a support fastened at its base to a flange and placed vertically, the yarn guide moving in a backward and forward motion parallel to the longitudinal axis of the support. To produce the frustoconical shape of the bobbin, the solution proposed is to use a drawing device, placed after the device for combining the filaments and a dancer roll placed between the drawing device and the yarn guide. The dancer roll can rotate freely about its spindle, which is fastened to the end of a spring-loaded arm, thereby making it possible to impose a predetermined tension in the yarn to be wound.

The frustoconical shape of the bobbin, the base of which consists of the flange, is then obtained by giving the speed of rotation of the drawing device a constant value and by slaving the speed of movement of the yarn guide and the speed of rotation of the support.

However, such a solution requires a novel structure of the implementation device by, on the one hand, winding the yarn onto a support placed vertically and, on the other hand, using a drawing device and a dancer roll. The existing structures therefore have to undergo significant technical modifications, requiring some financial investment which is not negligible in a manufacturing plant.

Furthermore, the addition of a flange to the base of the support is not without problems as regards precision in depositing the yarn in this region. Thus, the yarn at the flange may either be laid down in an excess amount, which, when unwinding it, results in take-up as a packet, causing the yarn then to break, or be laid down in an insufficient amount, which then causes fraying of the yarn when unwinding it, caused by it being pinched between various layers of coils.

Finally, for bobbins of this type, the yarn of which has not undergone a twisting operation and is not wavy, it is common to encounter yarn damage problems since the crossover of the non-twisted yarn, that is to say the angle between two intersecting coils, is not large enough. This is because when this angle is too small, should a filament of the yarn be pinched between two coils of the bobbin, the continuity of the unwinding operation will result in the loss of one or more filaments from the yarn at the pinching point, resulting in the deterioration of the yarn and the formation of a ring by filament accumulation.

SUMMARY OF THE INVENTION

To avoid these unwinding problems, it may be preferable to have a frustoconical bobbin whose two frustoconical ends, namely the base end and the unwind end, have different generatrices, that is to say different base and unwind angles with respect to the axis of the bobbin. Patent JP 10-218,489, although an application different from a glass yarn package since it relates to a feed pirn for cabling or braiding machines, shows such a bobbin shape and describes its method of formation. The bobbin is constructed in four steps, which correspond to four successive parts of the bobbin: the first part consists of the bottom part of the pirn and represents at most half of the height of the package—it is preferably much less than half of the package, the angle of this frustoconical base with respect to the axis of the bobbin being between 16 and 22°. The second part is obtained by means of layers which are parallel to those of the first part and have the same length, but the thickness of the layers decreases because of an acceleration of the movement of the reversal points towards the top of the pirn. The third part, constructed in layers which are parallel but are inclined differently from those deposited in the first and second parts, produces entirely the unwind cone, the final angle of which, with respect to the axis of the bobbin, is less than that of the base cone. Lastly, the fourth part is aimed at terminating the main body of the bobbin in a cylindrical form, by rapidly moving the bottom reversal point closer to the top reversal point.

However, this method requires, on the one hand, four separate winding steps and, on the other hand, a change of inclination at which the layers of yarn are deposited during these steps, something which does not simplify its implementation.

In addition, this winding method produces an angle of build of the first layers with respect to the axis of the bobbin which is too great for a winding operation such as that desired, namely the winding of glass yarn coming from a bushing. This large angle of build creates large circumferential variations between the circumference of the base cone and the circumference obtained at the end of the first step of the method; now, when winding glass yarn whose drawing speed must be kept constant in order to keep the yarn count constant, such circumferential variations would impose consequent variations in the speed of the bobbin support both when it is accelerating and when it is decelerating, something which is not easily achievable physically.

Moreover, in this method the component for guiding the yarn for its deposition consists of a guiding eyelet which moves parallel to the axis of the rotating bobbin support. However, this guiding mode cannot be envisaged for guiding a glass yarn for the purpose of winding it, particularly a yarn coming directly from a bushing. This is because, in the event of breakage of the filaments coming from the bushing, it would prove to be too complicated to restart the winding operation; it is too difficult after collecting the filaments to pass them again through the eyelet, which has a closed circumference. It is also impossible with an eyelet to transfer the winding of the yarn from one bobbin onto another bobbin without having to break the yarn, which impairs the optimization of the production times.

Furthermore, the eyelet has an opening, for passage of the yarn, which is much too large compared with the diameter of the said yarn for allowing precise guiding of the yarn deposition.

The object of the invention is therefore to obviate the aforementioned drawbacks and to provide a method of obtaining a frustoconical bobbin which has good mechanical strength and can be easily unwound, the winding taking place in a horizontal plane without requiring significant modifications to the conventional means of implementation already existing.

According to the invention, the method of winding a yarn in superposed layers onto a cylindrical support of longitudinal axis x and fastened around a spindle driven in a rotational movement, in which the yarn is wound by running over a yarn guide which moves with a backward and forward motion parallel to the x axis of the support and is controlled so as to form a bobbin whose shape has two frustoconical ends called the base cone and the unwind cone respectively, having respective generatrices which are inclined with respect to the x axis at two different respective acute angles, and a main body of frustoconical shape which joins the two frustoconical ends and the two end sections of which form the two bases of the respective two cones base and unwind cones with different diameters, D1 and D2 respectively, is characterized in that it comprises two rules governing the movement of the yarn guide, a first rule which is used to form part of the base cone, the last layer of yarn deposited according to this first rule going as far as the end of the unwind cone, and a second rule which is used to terminate the said base cone that has been started and, concomitantly, to form the main body and the unwind cone, the first layer of yarn deposited according to the second rule being parallel to the last layer deposited according to the first rule.

According to one characteristic of the invention, the first rule governing the movement of the yarn guide consists in establishing backward and forward motions parallel to the axis of the support between an initial position ($x_0$) and a final position ($x_z$) which correspond, in projection perpendicular to the support, to each of the end sections of the bobbin respectively, each backward and forward being defined by:

- a starting position ($x_j$), of which that one for the first movement is the initial position ($x_0$) and that one for the following movements is a position to the rear of the starting position for the previous movement and always to the front of the final position ($x_z$), the position for the last movement being dictated by the value of the diameter D1 desired for the base cone to be formed,
- an intermediate position ($x_i$) for reversal of the yarn guide, which position always lies to the rear of the intermediate position for the previous movement and lies to the front of the final position ($x_z$), and
- an ending position ($x_{j+1}$) which constitutes the starting position for the following movement, the last movement according to this first rule not causing a reversal since the last intermediate position which then corresponds to the final position The successive starting positions ($x_j$) according to the first rule are separated by an equal distance ($\delta$), and the successive intermediate reversal positions ($x_i$) according to the first rule are defined by the equation $x_i=x_0+i\Delta$, where A is a constant which depends on the slope to be given to the generatrix of the main body.

We should point out that, throughout the description, the words "front" and "rear" assigned to the term "position" are defined with respect to the positive direction of movement of the yarn guide from the position $x_0$ to the position $x_z$.

According to another characteristic, the second rule governing the movement of the yarn guide consists in executing backward and forward motions parallel to the axis of the support, between an initial position which constitutes the final position ($x_z$) of the yarn guide according to the first rule and a terminal position ($x_t$) which lies between the final position ($x_z$) according to the first rule, and which is dictated by the value of the diameter D2 desired for the unwind cone to be formed, and the starting position for the last movement according to the first rule, each backward and forward motion being defined by:

- a starting position ($x_k$), of which that one for the first movement is the final position ($x_z$) according to the first rule and that one for the following movements is a position to the rear of the starting position for the previous movement,
- an intermediate position ($x_m$) for reversal of the yarn guide, of which that one for the first movement is the ending position that the yarn guide ought to have assumed if it had reversed the movement at the final position ($x_z$) according to the first rule, and
- an ending position ($x_{k+1}$) which constitutes the starting position for the following movement,
- the starting and ending positions for a movement always being to the front of those for the previous movement so that each movement is shortened in terms of travel.

The successive starting positions ($x_k$) according to the second rule are separated by an equal distance ($\delta'$), and the successive intermediate reversal positions ($x_m$) according to the second rule are spaced apart by the same distance ($\delta$) as that separating the successive starting positions ($x_j$) according to the first rule.

According to another characteristic, the yarn guide is moved concomitantly with the movement parallel to the X axis in a coplanar movement perpendicular to the X axis so that the resulting movement is parallel to the generatrix of the main body. Thus, the thrown length remains constant for as precise a deposition of the yarn as possible.

According to an advantageous characteristic, the wound yarn has a waviness so that the crossover angle between two coils is between 0.5° and 6°.

The advantage of creating a waviness in the yarn is that it allows the crossover angle to be optimized so as to reduce the risk of forming rings when unwinding it.

BRIEF DESCRIPTION OF THE DRAWINGS

This method is advantageously applied for winding glass yarn coming directly from a bushing.

Other features and advantages of the invention will appear on reading the description which follows, with reference to the drawings in which.

DETAILED DESCRIPTION OF THE INVENTION

Figure 1:
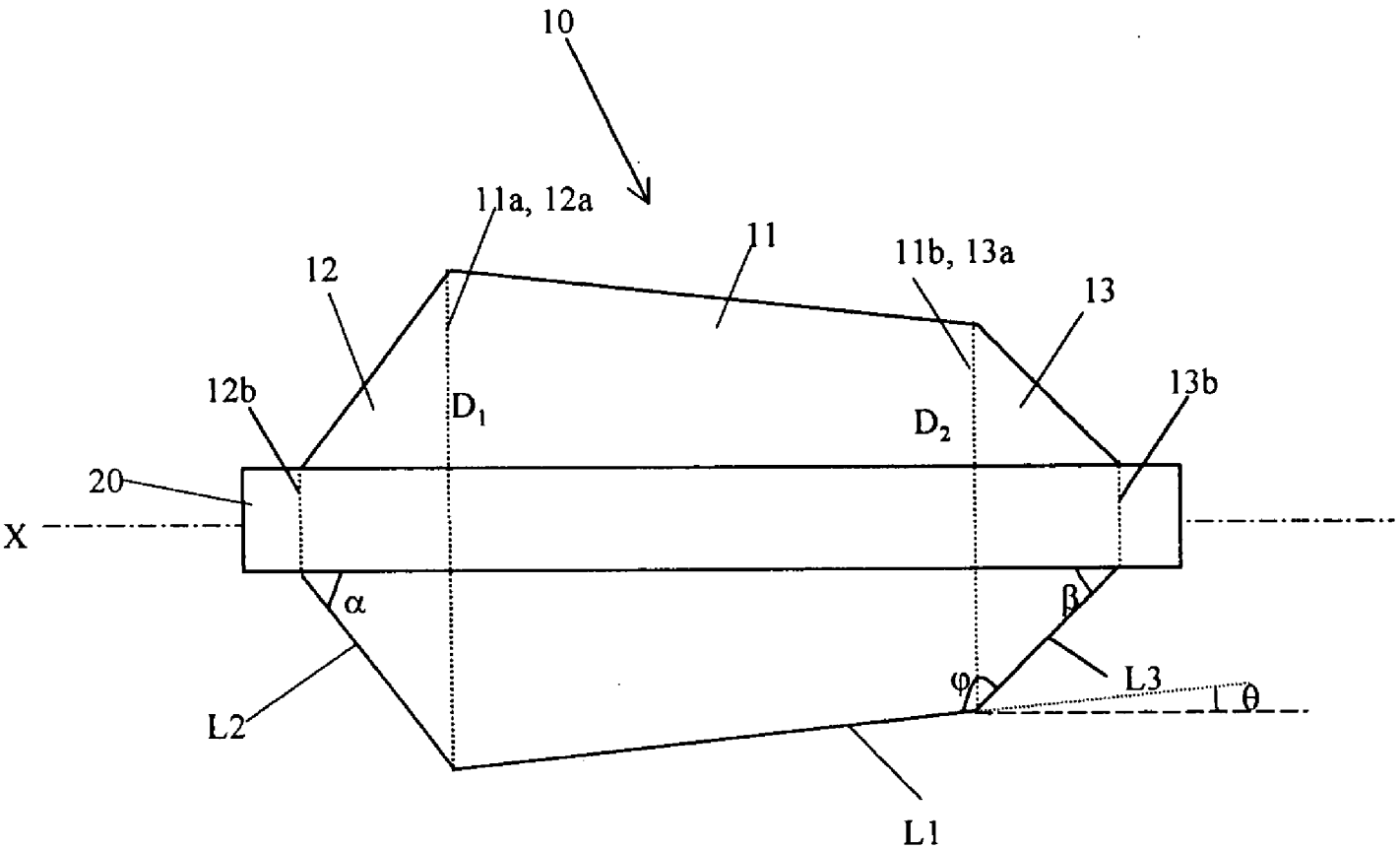
FIG. 1 is a longitudinal sectional view of the bobbin according to the invention on its package support.
Figure 1A:
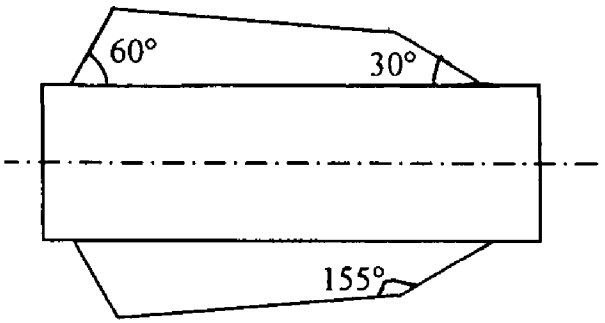
FIGS. 1*a* to 1*d* illustrate several examples of frustoconical bobbins according to the invention.
Figure 1B:
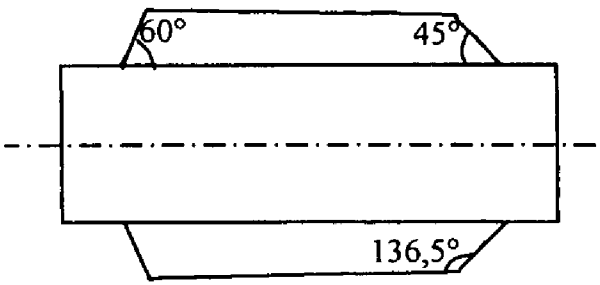
Figure 1C:
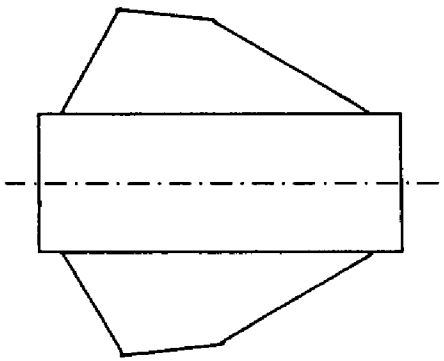

FIG. 1 shows a frustoconical bobbin 10 produced according to the invention, obtained by winding a yarn around a cylindrical support 20 of longitudinal axis X, the support being without any flange at its ends. The wound yarn is glass yarn for example.

The bobbin 10 comprises a bobbin body 11 of frustoconical shape and two truncated cones 12 and 13 located respectively at the two longitudinal opposed ends of the bobbin, on each side of the bobbin body 11.

The bobbin body 11 has a base 11*a* of diameter D1 and a terminal section 11*b* of diameter D2 less than the diameter D1, the generatrix L1 of the frustoconical body 11 thus being inclined with respect to the X axis at an angle θ.

The end truncated cone 12 formed firstly during the winding operation will be called hereafter the base cone. It has a base 12*a* consisting of the base 11*a* of the bobbin body 11 of diameter D1 and a termination 12*b*, the diameter of which corresponds to that of the support 20. The truncated cone 12 has a generatrix L2 whose slope makes an acute angle α with the surface of the support 20 or with the X axis.

The second end truncated cone 13 will be called the unwind cone since, its cross section always being smaller than that of the base cone, the unwinding will take place from that cone in order to make it easier for the yarn to be detached from the bobbin. The unwind cone 13 has a base 13*a* consisting of the terminal section 11*b* of the bobbin body 11 of diameter D2 and a termination 13*b* whose diameter corresponds to that of the support 20. The truncated cone 13 has a generatrix L3 whose slope makes an acute angle β with the surface of the support 20 or with the X axis, the value of β being independent of that of the angle α.

The generatrices L2 and L3 of the base 12 and unwind 13 cones are therefore inclined with respect to the X axis in opposite directions in order to be joined to the generatrix L1 of the frustoconical body 11.

The bobbin 10 thus formed from three truncated cones makes it possible to increase its mechanical integrity as well as to improve the quality of the unwinding operation and consequently to preserve the properties of the yarn as far as possible, these being especially its integrity and its tensile strength. This end product furthermore is very easy to use during subsequent conversion of the glass fibre.

The base cone 12 constitutes the place where it is possible to build up the most yarn on the package, contributing to increasing the weight of the latter.

Thus, the angle α may be as close as possible to the perpendicular to the X axis, up to a limit which defines the occurrence of sloughing-off during winding or during transportation. Advantageously, the angle α will be between 40° and 75° with respect to the X axis.

The angle β of the unwind cone 13 mainly affects the retention of the coils at the point where the yarn guide reverses, also called the reversal point; the angle β will preferably have a value of between 30° and 60° with respect to the X axis.

Values of these angles are also chosen according to the quality of the sizing composition which makes the surface of the fibres slippery.

Figure 1D:
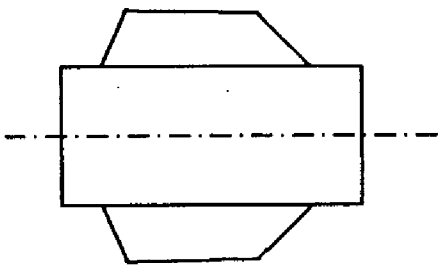

FIGS. 1*d* to 1*d* illustrate the combination of the various values of the angles α and β for several bobbin lengths. The length of the bobbin between the terminations 12*b* and 13*b* may vary between 150 mm and 500 mm, and preferably between 180 mm and 400 mm.

The ease of unwinding already provided by the frustoconical shape of the bobbin is demonstrated by characteristics specific to the wound yarn.

Figure 2:
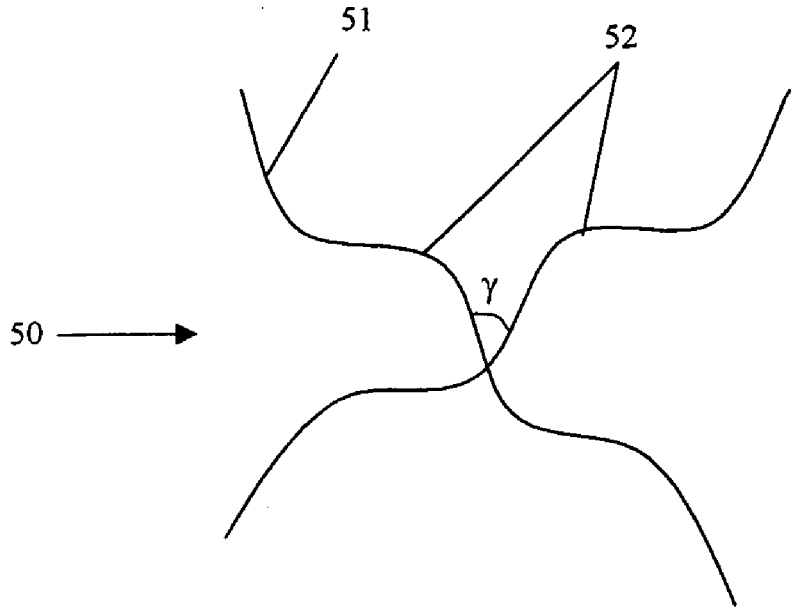
FIG. 2 illustrates two intersecting coils of yarn.

Thus, as illustrated in FIG. 2, the wound yarn 50 comprises coils 52, two adjacent coils of which intersect at a crossover angle γ, and has a waviness 51. How these characteristics are obtained will be explained later.

Figure 3:
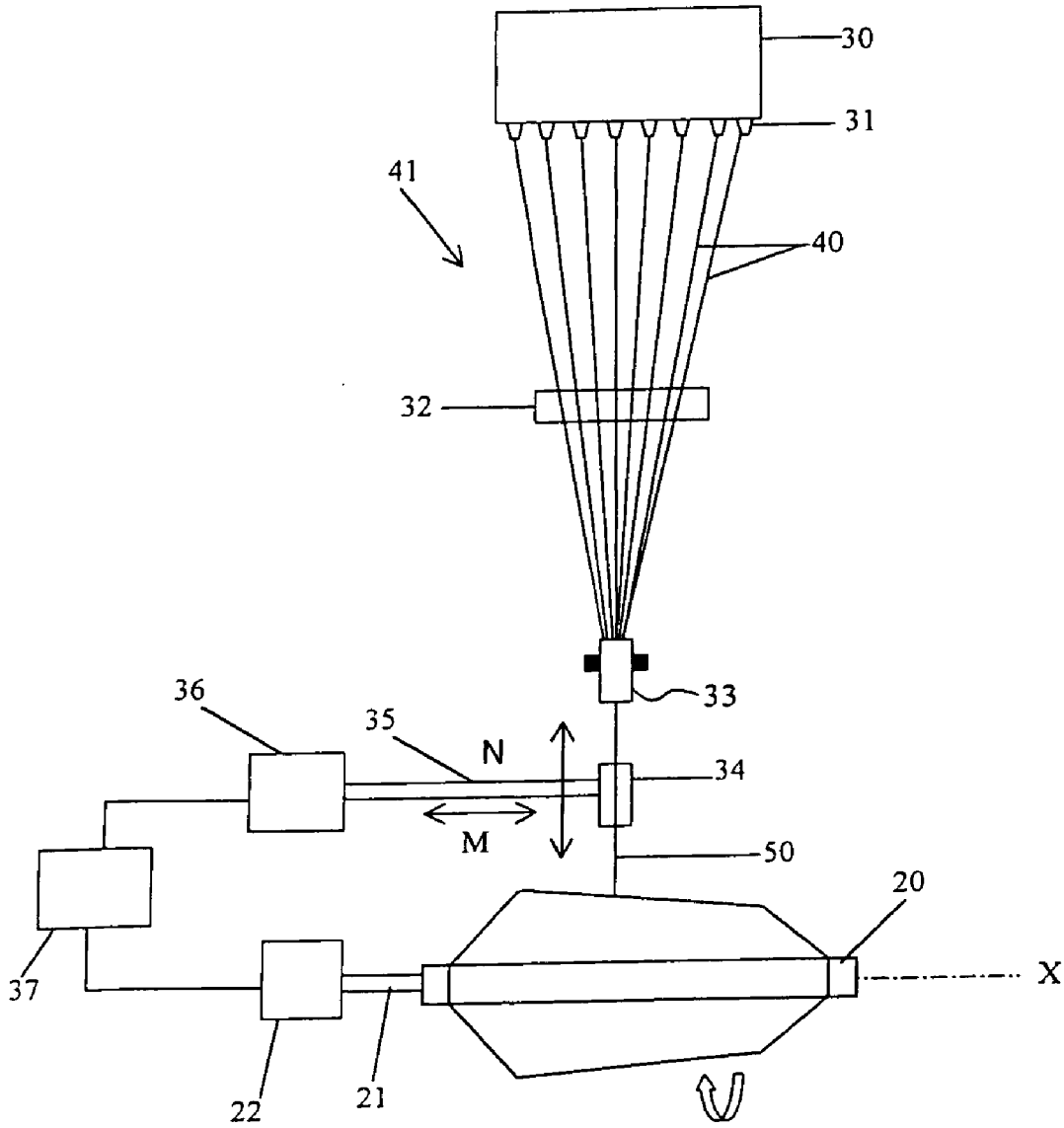
FIG. 3 shows a schematic view of a plant allowing the method according to the invention to be implemented.
Figure 5:
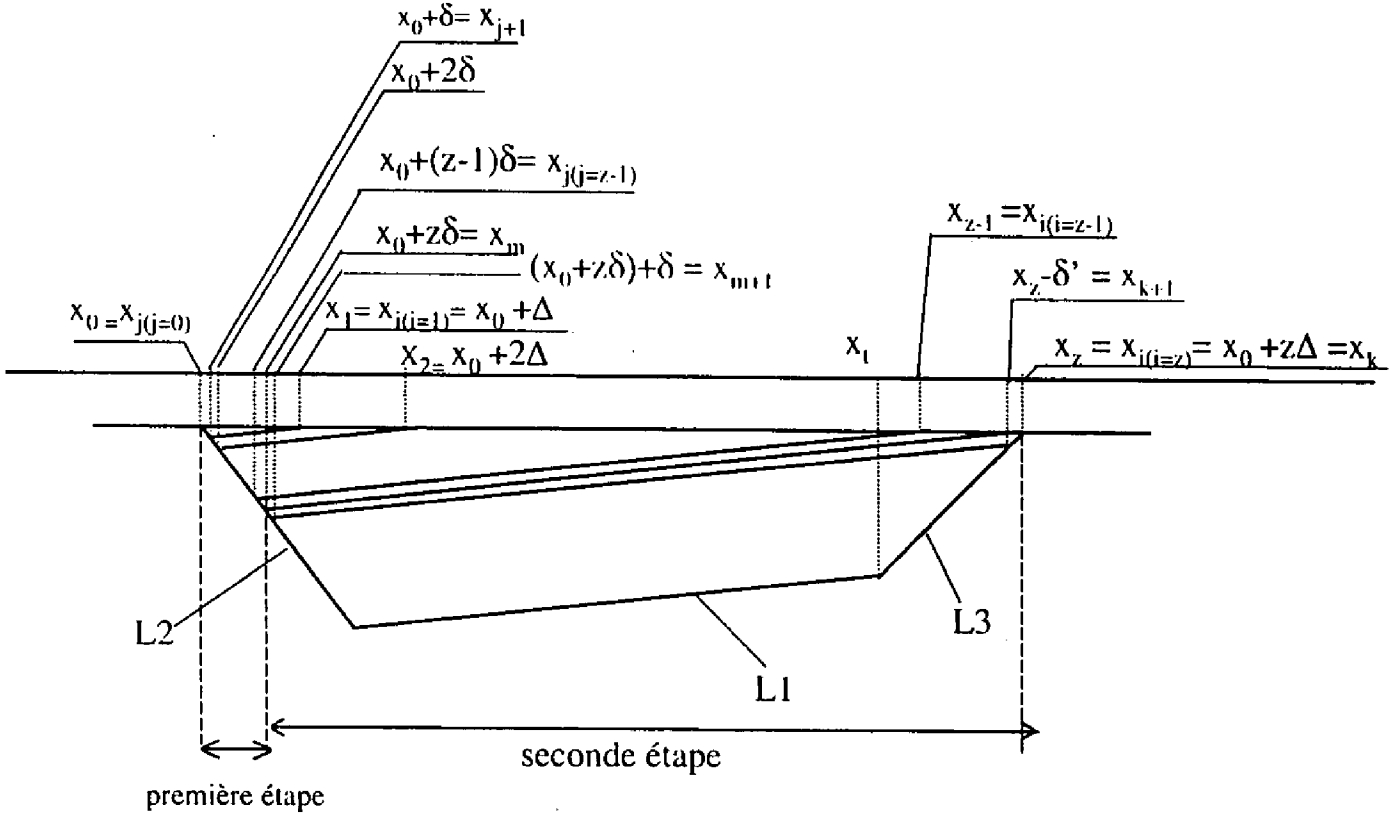
FIG. 5 shows various positions taken by the yarn guide along its axis of movement parallel to the support, combined with a longitudinal partial sectional view of the bobbin.
Figure 6:
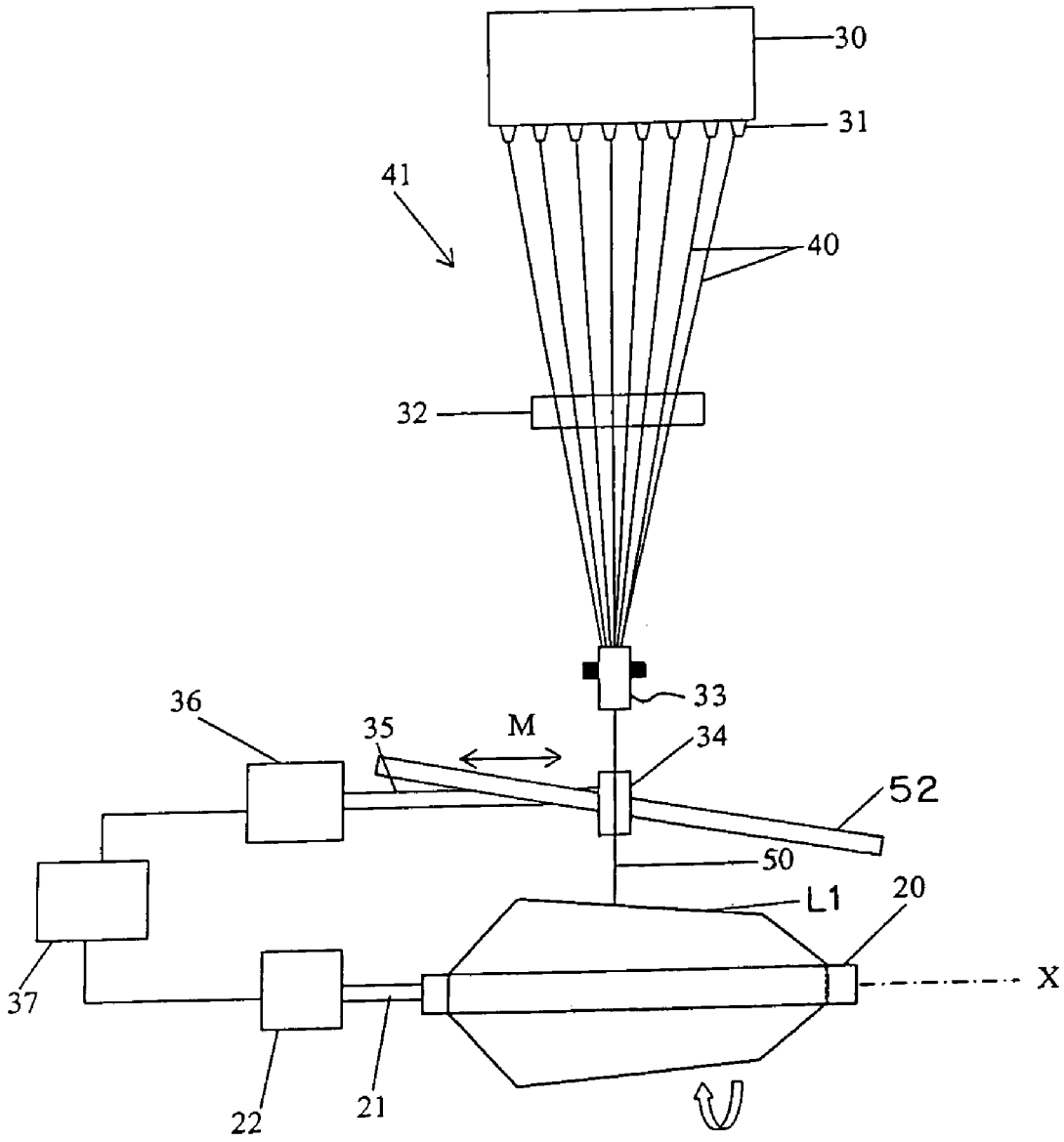
FIG. 6 shows a schematic view of another plant allowing the method according to the invention to be implemented.

The winding method according to the invention, allowing a bobbin such as that described above to be manufactured may be employed within the context of a plant which is illustrated schematically in FIG. 3.

The plant comprises a bushing 30 supplied with glass via a feed supply (not shown).

The bushing may be fed with cold glass, obtained and stored in the form of balls in a hopper placed above the bushing, the bushing then being heated in order to remelt the glass, or may be fed directly with molten glass, the bushing also being heated in order to maintain the glass at a sufficient temperature so that it reaches the viscosity suitable for drawing it in the form of continuous filaments.

The molten glass flows vertically through a multiplicity of orifices, such as the teats 31, and is immediately drawn into a multiplicity of filaments 40, which are collected here into a single sheet 41.

This sheet 41 comes into contact with a coater 32 intended to coat each filament with a sizing composition of the aqueous or anhydrous type. The device 32 may consist of a tank permanently fed with a sizing solution and of a rotating roller, the lower part of which is constantly immersed in the solution.

This roller is permanently covered with a film of sizing composition which is picked up by the filaments 40 as they pass, sliding over its surface.

The sheet 41 then converges on a combining device 33 where the various filaments are combined to create the yarn 50. The combining device 33 may consist of a simple grooved pulley or of a plate provided with a notch.

The yarn 50 on leaving the combining device 33 enters a yarn guide 34, such as a cam, to be wound around the support 20 placed in a horizontal plane with respect to the vertical entry of the yarn into the yarn guide. The yarn, coming directly from the bushing, is therefore wound without any intermediate step such as the prior manufacture of a cake.

The support 20 is fastened to a spindle 21 which is driven in a rotational movement. The support 20 is advantageously hollow, its internal shape matching the external shape of the spindle 21 and its internal cross section being somewhat greater than the cross section of the spindle, in order to be slipped over the latter and to be held gripped around it by a spindle expansion device (not visible).

The spindle 21 is rotated by a motor 22, the drive speed of which can be adjusted.

The yarn guide 34 is driven with a horizontal backward and forward motion M parallel to the longitudinal axis X of the support and, preferably, with a horizontal backward and forward motion N perpendicular to the X axis, the latter motion being carried out concomitantly with the motion M as will be explained later.

The yarn guide 34 is fastened to the end of a moveable arm 35 controlled by an electronic drive device 36.

A control device 37, such as a programmable controller, is provided for controlling the movement of the moveable arm 35 and the speed of movement of the yarn guide 34 and the speed of rotation of the spindle 21.

The speed of rotation of the spindle 21 and the speed of linear movement of the yarn guide 34 parallel to the X axis may vary. These speed variations may be employed optionally, depending on the desired quality of the yarn after winding. The speed of rotation of the spindle is dictated by the bushing output rate and the desired linear density of the yarn. As regards the speed of the yarn guide, this has an influence on the quality of the unwinding.

It is known that the linear density of the yarn corresponds to the ratio of the bushing output rate to the yarn drawing rate. It is always desirable for the linear density to be constant so that the wound yarn is of uniform quality in terms of mechanical behavior.

However, the variation in cross section of the bobbin 10 necessarily means that there is a variation in the drawing rate. In order for the linear density to be constant, it is therefore necessary to keep the drawing rate constant assuming that the bushing output rate remains constant. The yarn guide has no effect on the drawing of the yarn, the drawing rate depending only on the speed of rotation of the spindle. The speed of rotation of the spindle 21, and therefore of the support 20, is therefore varied so that the yarn always encounters a surface whose peripheral speed is approximately constant.

The constancy of the yarn linear density is controlled by programming the drawing rate imposed by the speed of rotation of the spindle 21 and according to the position of the yarn guide corresponding to a given cross section of the bobbin.

Thus, by suitably varying the speed of rotation of the spindle according to the cross section of the bobbin, it is possible to keep the linear density of the yarn constant.

On the other hand, if no variation is imposed, the linear density of the yarn varies about a median value, the amplitude of the variation depending on the angle θ of the generatrix L1 with the X axis.

As regards the speed of movement of the yarn guide, this can therefore also vary. By varying this speed, the angle θ of the generatrix L1 with the X axis is maintained during winding, thereby making it possible for the unwinding properties to be kept constant whatever the position of the yarn.

On the other hand, if no variation is imposed, the angle θ decreases during winding, which may result in a reduction in the quality of the unwinding to the outside of the bobbin.

Figure 4:
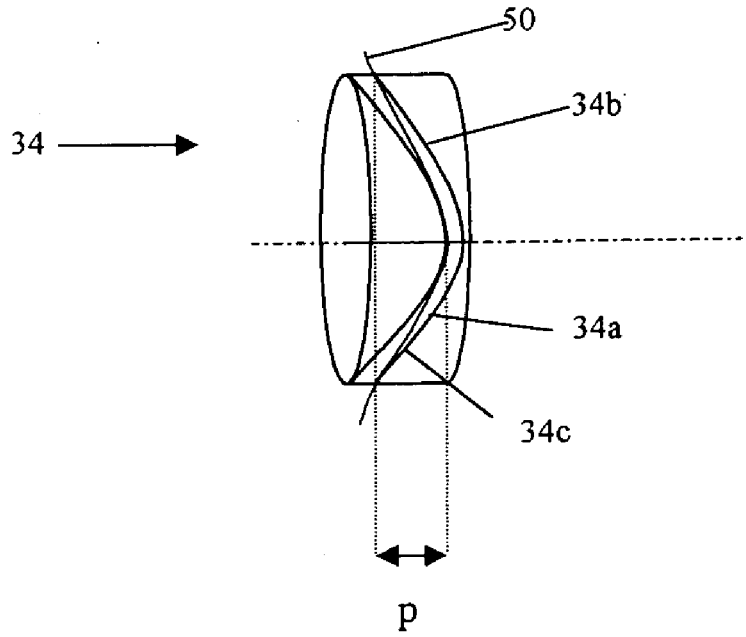
FIG. 4 shows a side view of a yarn guide consisting of a cam through which the yarn runs.

The yarn guide 34, as we have already mentioned, preferably consists of a cam as illustrated in FIG. 4.

This cam has a continuous groove 34*a* along which the yarn 50 runs. The groove is of helicoidal general shape and has at least two sections 34*b* and 34*c* of opposite respective slopes.

The cam has a pitch p which corresponds to the width, measured parallel to the axis of rotation, between the two points at which the yarn passes tangentially over a section, at which points the curving of the yarn takes place. This pitch determines the amplitude given to the waviness of the yarn.

The helicoidal shape of the groove makes it possible, during winding, to give the yarn a waviness, the number of sinusoids of which over one coil and their width depend on the pitch p of the cam and on the speed of rotation of the latter.

The periodicity of the waviness, that is to say the number of sinusoids, acts on the number of crossovers of the yarn when several layers of coils are superposed. The proportion of crossovers must advantageously be balanced. This is because, the greater the proportion of crossovers the better the mechanical integrity of the bobbin and better the unwindability; but, on the other hand, for equivalent weight of yarn, the overall size of the bobbin increases, something which is a problem when transporting it and which reduces the length of yarn available for weaving operations such as warping.

Thus, the speed of rotation of the cam is adapted in order to establish a suitable periodicity of the waviness. This speed may be defined with respect to the drawing rate of the yarn—it varies between −10% and +30% of the value of the drawing rate and preferably between the value of the drawing rate and +15% of this value.

Not only do the crossovers prevent slippage of a coil from one of the layers on the coils of a lower layer, thus achieving better mechanical integrity of the bobbin once it has been formed and making it easier for the yarn to be unwound, but the crossover angle γ also helps in the precision of cone formation and prevents the last coil of the bobbin becoming free.

Furthermore, since the crossover angle and the waviness establish the length of free coil formed in the package, this length should be short in order to avoid the risk of the yarn tearing when it disengages from the coils around the unwind cone when rubbing phenomena occur, such as that of double ballooning.

The mean value of the angle γ depends on the speed of movement of the yarn guide 34 parallel to the X axis and on the speed of rotation of the spindle 21.

As regards the actual value of the angle γ at each crossover point, this also depends on the combination of the movement of the yarn guide and of the position of the yarn caused by the position of the yarn guide at the moment the yarn is deposited on the package surface.

A suitable mean value of the crossover angle γ is preferably between 0.5° and 6°.

The winding method according to the invention is based on the backward and forward motion imposed on the yarn guide 34. It is decomposed into two steps according to two respective rules governing the movement, the first creating part of the generatrix L2 of the base cone 12 and the second terminating the generatrix L2, and then simultaneously forming the generatrices L and L3 of the body 11 and of the unwind cone 13 respectively.

The first step consists in moving the yarn guide between an initial position $x_0$ which corresponds to an end position of the bobbin for which the first coil of the bobbin is wound, that is to say the position of the termination 12*b* of the base cone 12, and a final position $x_z$ which corresponds to the position of the opposite end of the bobbin, that is to say of the base 13*b* of the unwind cone 13.

Between the positions $x_0$ and $x_2$, the yarn guide 34 performs several backward and forward movements $d_i$, each of which comprises a forward travel $a_i$ towards the position $x_z$ and a return travel R; towards the initial position $x_0$.

The first movement $d_1$ comprises the forward travel $a_1$ and the return travel $R_1$, the forward travel $a_1$ starting from the initial position $x_0$ and ending at the position $x_1$ such that $x_1=x_0+\Delta$, and the return travel $R_1$ starting at the position $x_1$ and ending at the position $x_0+\delta$, the yarn guide not returning to the initial position $x_0$.

The second movement $d_2$ comprises the forward travel $a_2$ and the return travel $R_2$, the forward travel $a_2$ starting at the last position of the yarn guide $x_0+6$ and stopping at the position $x_2$ to the rear of the position $x_1$, such that $x_2=x_0+2\Delta$, and the return path $R_1$ starting at the position $x_2$ and stopping at the position $x_0+2\delta$.

The penultimate movement $d_z-1$ will comprise the forward travel $a_z-1$ and the return travel $R_z-1$, the forward travel $a_z-1$ starting from the final position $x_0+(z-2)\delta$ of the return travel of the previous movement and stopping at the position $x_z-1$, such that $x_z-1=x_0+(z-1)\Delta$, and the return path $R_z-1$ starting at the position $x_z-1$ and stopping at the position $x_0+(z-1)\delta$.

The final movement $d_z$ will comprise only a forward travel $a_z$ and no return travel, the forward travel $a_z$ starting from the final position $x_0+(z-1)^8$ of the return travel of the previous movement and stopping at the final position $x_z$, such that $x_z=x_0+z\Delta$. The starting position $x_0+(z-1)\delta$ of the final movement is defined according to the desired value of the diameter D1 of the base cone.

Consequently, the yarn guide 34 performs, between the position $x_0$ and the position $x_z$, backward and forward movements, each of which defines:

- a starting position $x_j=x_0+j\delta$, where j varies from 0 to (z−1) and z is a non-zero integer,
- an intermediate reversal position, or position for the return in the opposite direction, $x_i=x_0+i\Delta$, where i varies from 0 to z, z being a non-zero integer, and
- an ending position constituting the next
- starting position $x_{j+}1=x_j+\delta=x_0+(j+1)\delta$, the last movement of this first step corresponding to a travel as far as the position $x_z$ without return in the opposite direction.

The fact of not returning to the starting position of the previous movement makes it possible to build part of the generatrix L2 of the base cone 12.

The value of $\delta$ corresponds to the angles $\alpha$ and $\beta$ that it is desired to give the base and unwind cones.

The constant positive value of $\Delta$ depends on the slope that it is desired to give the generatrix L1 and therefore depends on the value of $\delta$. The smaller the value of $\Delta$, the larger the angle $\theta$ of the generatrix L1 with the X axis. This value $\Delta$ is chosen so that the angle $\theta$ is between 0.5° and 5° and preferably between 0.75° and 3°.

For the second step, the yarn guide 34 performs traverse movements between the position $x_z$ occupied at the end of the first step and a terminal position $x_t$ for which the desired diameter D2 of the base 13*a* of the unwind cone is reached.

Each movement comprises a forward travel starting at a position $x_k$ and a return travel starting at an intermediate reversal position $x_m$ and stopping at an ending position $x_k+1$, the yarn guide always stopping to change direction at a position to the front of the position occupied at the start or at the end of the previous movement. The forward and return travels therefore decrease in length in both directions.

Thus, the first movement comprises a forward travel starting at the position $x_k=x_z$ and ending at the position $x_0+(z-1)\delta+\delta$, or $x_0+z\delta$, where $x_0+(z-1)\delta$ corresponds to the starting position of the last movement of the first step, and a return travel starting at the position $x_m=x_0+z\delta$ and finishing at the position $x_k+1=x_z-\delta'$.

At the next movement, the forward travel starts at the position $x_z-\delta'$, ends at the intermediate reversal position $x_0+z\delta+\delta$ and moves away again as far as the position $x_z-2\delta'$.

As the forward and return travels of the yarn guide proceed, the bobbin body 11 and the unwind cone 13 form. The final movement of the yarn guide 34 is programmed so that it stops at the position $x_t$, which corresponds to the position $x_z-t\delta'$, for which the desired value of the diameter D2 is reached.

The value of $\delta'$ depends on the angles $\alpha$ and $\beta$ that it is desired to give the base and unwind cones, $\delta'$ generally being greater than $\delta$.

The movements of the second rule may therefore be defined by:

- a starting position $x_k=x_z-n\delta'$, where n varies from 0 to t and t is a non-zero integer,
- an intermediate reversal position $x_m=(x_0+z\delta)+p\delta$, where p varies from 0 to (t−1), and
- an ending position constituting the next starting position $x_{k-1}=x_k-\delta'$.

We have explained that the yarn guide is driven with a motion M parallel to the X axis. It turns out that this motion in this single direction may entail a few difficulties which we will now explain and which, nevertheless, can be resolved by employing optional characteristics of the method depending on the desired quality of the winding.

The variation in cross section of the bobbin, particularly a decreasing cross section at the body 11 and the unwind cone 13, creates, when the yarn guide moves at a constant rate, as the cross section gradually decreases, a very substantial increase in the thickness of the bobbin, which is manifested, at the end of the winding operation, by a decrease in the angle $\phi$ between the generatrices L1 and L3, an angle which may be greater than 1° . This is because, assuming that the bushing outputs a constant amount of glass per unit of time while the yarn guide is moving at a constant rate, an identical mass of glass per unit of time is then deposited on the suppport; however, since the cross section of the bobbin is not uniform, a larger amount of yarn is deposited as the cross section decreases.

Furthermore, as the cross section decreases, the distance separating the yarn guide from the surface of the bobbin, a distance usually called the thrown length, increases, thereby increasing the precision with which the yarn is deposited, which means, on the one hand, that the package is less stable, particularly on the unwind cone side, and, on the other hand, that the quality of the unwinding suffers.

To ensure constant precision of yarn deposition, it is more advantageous when carrying out the method to perform, at the same time as the motion M parallel to the X axis, a motion N perpendicular to the X axis towards the bobbin being formed, in order to compensate for the variation in thrown length, the sum of the movement M and N corresponding to a movement parallel to the generatrix L1 so that the thrown length remains constant.

This motion N, perpendicular to the X axis in the same horizontal plane as that of the motion M, is accomplished by controlling the moveable arm 35.

The movements are performed by means of the moveable arm 35, the motion of which is controlled by the electric device 36. As a variant, it would be possible to use mechanical means consisting of a fixed guiding rail 52 which is parallel to the future generatrix L1 and along which the yarn guide 34 would run.

What is claimed is:

1. A method of winding a yarn in a plurality of superposed layers onto a cylindrical support having a longitudinal axis and fastened around a spindle driven in a rotational movement, in which the yarn is wound by running over a yarn guide which moves in a backward and forward motion (M) parallel to the longitudinal axis of the support and is controlled so as to form a bobbin having a shape with two frustoconical ends, said bobbin comprising a base cone having a first generatrix inclined at a first acute angle to the longitudinal axis and an unwind cone having a second generatrix inclined at a second acute angle to the longitudinal axis, and a main body which joins the two frustoconical ends and has a frustoconical shape, said main body comprising a third generatrix, a first end section which forms a base of the base cone and a second end section which forms a base of the unwind cone, wherein a diameter of said base of the base cone is different than a diameter of the base of the unwind cone, said method of winding a yarn comprising, governing the movement of the yarn guide with a first rule for forming a part of the base cone wherein a last layer of yarn deposited according to said first rule going as far as the end of the unwind cone, and a second rule for terminating the base cone while forming the main body and the unwind cone, wherein a first layer of yarn deposited according to the second rule is parallel to a last layer of yarn deposited according to the first rule.

2. The method according to claim 1, wherein the first rule governing the movement of the yarn guide comprises establishing a plurality of backward and forward motions parallel to an x axis between an initial position ($x_o$) and a final position ($x_z$), such that imaginary lines passing through the initial position ($x_o$) and the final position ($x_z$) and intersecting the support and each end of the sections of the bobbin are perpendicular to the support and to each of the end sections of the bobbin, wherein each backward and forward motion comprises:

a starting position ($x_j$), a first movement having the initial position ($x_o$) and the final position ($x_z$), wherein said starting position for a movement following the initial movement or a movement subsequent to the initial movement is to the rear of the starting position of a previous movement and in front of the final position ($x_z$), a position for the last movement is defined by the diameter of the base cone, an intermediate position ($x_i$) for reversal of the yarn guide, wherein an intermediate position for a movement is always to the rear of an intermediate position for a previous movement and is to the front of the final position ($x_z$), and an ending position ($x_{j+1}$) which is a starting position for the subsequent movement wherein a last intermediate position is the final position ($x_z$) and the last movement does not cause a reversal.

3. The method according to claim 2, wherein the second rule governing the movement of the yarn guide comprises executing backward and forward motions parallel to the longitudinal axis, between an initial position, said initial position the final position ($x_z$) of the yarn guide according to the first rule and a terminal position ($x_t$) between the final position ($x_z$) according to the first rule, defined by the diameter of the unwind cone, and the starting position for the last movement according to the first rule, each backward and forward motion comprising:

a starting position ($x_k$), wherein a position of the first movement is the final position ($x_z$) according to the first rule, and a position for a subsequent movement is to the rear of the previous movement, an intermediate position ($x_m$) for reversal of the yarn guide, wherein an intermediate position for the first movement is an ending position corresponding to a position of reversal of a movement at the final position ($x_z$) according to the first rule, and an ending position ($x_{k+}1$) wherein said ending position is a starting position for the following movement, the starting and ending positions for a movement always in front of a position for a previous movement to shorten a travel of each movement.

4. The method according to claim 2, wherein a plurality of successive starting positions ($x_j$) according to the first rule are separated by a first distance.

5. The method according to claim 2, wherein a plurality of successive intermediate reversal positions ($x_i$) according to the first rule are defined by the equation $x_i=x_o+i\Delta$, where $\Delta$ is a positive constant which depends on a slope to be given to the third generatrix, and i varies from 0 to Z, where Z is a non-zero integer.

6. The method according to claim 3, wherein a plurality of successive starting positions ($x_k$) according to the second rule are separated by a second distance.

7. The method according to claim 3, wherein a plurality of successive intermediate reversal positions ($x_m$) according to the second rule are spaced apart by the first distance.

8. The method according to claim 1, wherein the yarn guide is moved concomitantly with the motion (M) parallel to the longitudinal axis in a coplanar motion (N) perpendicular to the longitudinal axis so that a resulting motion is parallel to the third generatrix.

9. The method according to claim 8, wherein a plurality of motions parallel (M) and perpendicular (N) to the longitudinal axis of the yarn guide is produced by an electronic drive device.

10. The method according to claim 8, wherein the yarn guide is moved by running along mechanical guiding means placed parallel to the third generatrix the main body being formed.

11. The method according to claim 1, for which the yarn guide comprises a cam, wherein the speed of rotation of the cam is varied.

12. The method according to claim 1, wherein a speed of rotation of the spindle is varied.

13. The method according to claim 1, wherein a speed of movement of the yarn guide parallel to the longitudinal axis is varied.

14. A frustoconical bobbin obtained by the method according to claim 1, wherein the first acute angle of inclination of the first generatix of the base cone is between 40° and 75°.

15. A frustoconical bobbin obtained by the method according to claim 1, wherein the second acute angle of inclination of the second generatix of the unwind cone is between 30° and 60°.

16. A method of winding a yarn in a plurality of superposed layers onto a cylindrical support having a longitudinal axis and fastened around a spindle driven in a rotational movement, in which the yarn is wound by running over a yarn guide which moves in a backward and forward motion (M) parallel to the longitudinal axis of the support and is controlled so as to form a bobbin having a shape with two frustoconical ends, said bobbin comprising a base cone having a first generatrix inclined at a first acute angle to the longitudinal axis and an unwind cone having a second generatrix inclined at a second acute angle to the longitudinal axis, and a main body which joins the two frustoconical ends and has a frustoconical shape, said main body comprising a third generatrix, a first end section which forms a base of the base cone, and a second end section which forms a base of the unwind cone, wherein a diameter of said base of the base cone is different than a diameter of the base of the unwind cone, said method of winding a yarn comprising, governing the movement of the yarn guide with a first rule for forming a part of the base cone wherein a last layer of yarn deposited according to said first rule going as far as the end of the unwind cone, and a second rule for terminating the base cone while forming the main body and the unwind cone, wherein a first layer of yarn deposited according to the second rule is parallel to a last layer of yarn deposited according to the first rule, wherein the first acute angle of inclination of the first generatix of the base cone is between 40° and 75°, and, wherein the yarn has a waviness to allow two coils with two superposed layers to intersect at a crossover angle.

17. The frustoconical bobbin according to claim 16, wherein the crossover angle is between 0.5° and 6°.

18. The frustoconical bobbin according to claim 14, wherein said bobbin has a length, measured between the two end bases of the base and unwind cones between 150 mm and 500 mm.

19. The method as claimed in claim 1, comprising collecting a multiplicity of glass filaments formed from a plurality of streams of molten glass wherein said streams of molten glass emanate from a plurality of orifices of a bushing and combing the glass filaments into said yarn.

* * * * *